US006488477B1

(12) United States Patent
Hurr

(10) Patent No.: US 6,488,477 B1
(45) Date of Patent: Dec. 3, 2002

(54) MATERIAL FEED CONTAINER, ESPECIALLY FOR THICK MATERIAL PUMPS

(75) Inventor: Hellmut Hurr, Reutlingen (DE)

(73) Assignee: Putzmeister Aktiengesellschaft (DE)

( * ) Notice: Subject to any disclaimer, the term of this patent is extended or adjusted under 35 U.S.C. 154(b) by 0 days.

(21) Appl. No.: 09/674,548

(22) PCT Filed: Apr. 10, 1999

(86) PCT No.: PCT/EP99/02777

§ 371 (c)(1),
(2), (4) Date: Nov. 1, 2000

(87) PCT Pub. No.: WO99/58235

PCT Pub. Date: Nov. 18, 1999

(30) Foreign Application Priority Data

May 8, 1998 (DE) ..... 198 20 509

(51) Int. Cl.[7] ..... F04B 15/02; F04B 53/00
(52) U.S. Cl. ..... 417/234; 417/519; 417/900
(58) Field of Search ..... 366/331, 154.1, 366/318; 417/234, 517, 519, 900

(56) References Cited

U.S. PATENT DOCUMENTS 3,682,575 A * 8/1972 Guddal et al. ..... 137/625.48
5,061,158 A * 10/1991 Egli ..... 417/519
5,141,414 A * 8/1992 Pierce et al. ..... 417/430
5,460,301 A * 10/1995 Ebinger et al. ..... 137/625

* cited by examiner

*Primary Examiner*—Charles G. Freay
(74) *Attorney, Agent, or Firm*—Pendorf & Cutliff

(57) ABSTRACT

A material feed container (20), especially for thick material pumps, comprising a lower container component (38) that is upwardly open and a motor-driven agitator (44) that extends through the lower container component (38) in-between two side walls (50). In order to make the inside of the container easily accessible for cleaning and maintenance purposes, the agitator (44) is provided with a pivot bearing (56) and a drive motor (48) which together form a structural unit which is detachably connected to the lower container component (38). The container is also provided with a top piece (40) that is open towards the top and bottom, can be detachably arranged on the top edge of the lower container component (38) and can be connected to the lower container component (38) and/or agitator unit if so desired. These measures make it possible to pivot or remove the top piece (40) from/in relation to the container lower component (38) without the agitator unit or to remove it from the container lower component (38) with the agitator unit.

21 Claims, 5 Drawing Sheets

MATERIAL FEED CONTAINER, ESPECIALLY FOR THICK MATERIAL PUMPS

BACKGROUND OF THE INVENTION

FIELD OF THE INVENTION

The invention concerns a material feed container, in particular for thick material pumps, with a container lower part having a container floor, a front wall, a back wall and two opposing side walls and with an agitator driven by at least one motor, the motor provided on the container outside, the agitator extending from side wall to side wall in the lower part of the container on an axial drive shaft, the drive shaft mounted on pivot bearings extending respectively through one of the side walls.

In a known material supply container the agitator is mounted in two container fixed bearings and is driven by two hydraulic motors provided on the outer side of the container. The bearings and the motors are assembled fixedly to the material supply container. In a two-cylinder thick material pump the agitator in the material supply container covers over the pivot pipe or pipe switch of the pump and a part of the pump opening. In order to have access to these parts, for example for servicing, the agitator must be removed. For disassembly of the agitator and the motors, first the agitator "wings" must be removed from the shaft, before the shaft axle can be extracted from the bearings. For this, securing screws with which the agitator wings are secured to the drive shaft axle must be released. After extended operation of the pump, the screws are frequently seated so tightly as a result of the concrete deposits that they can be removed only with the aid of a cutting device.

SUMMARY OF THE INVENTION

Beginning herewith, it is the task of the invention to improve the known material supply container in such a manner that a simplified access to the components and locking parts situated in the container is made possible.

The inventive solution is based on the concept that the agitator, the bearings therefore and the at least one motor form one structural unit, which as such is removably associated with the container lower part.

According to a preferred embodiment of the invention the pivot bearing is for this purpose provided in respectively one mounting block, while the side walls respectively exhibit one upwardly open recess for fluid tight receiving of the mounting block which in its outer contour is adapted to the inner contour of this recess. In order to insure a distortion-free force transmission between the mounting blocks and the container lower part, it is proposed in accordance with an advantageous embodiment of the invention, that the mounting blocks under application of force directed parallel to the side walls are form-fittingly connectable to the side walls. Preferably the recesses exhibit an edge part projecting on the container outer side at least partially beyond the side wall, with an inner contour adapted to the outer contour of the mounting block, wherein two opposing parts of the edge part can be provided with through-holes, which align with each other and also are in alignment with a transverse borehole situated in the mounting block, through which a tensioning screw can be introduced for fixing the mounting block in the recess. In this manner it is possible, substantially by the retraction of the two tensioning screws, to separate the agitator structural unit from the container lower part, so that it can be lifted therefrom with the aid of a lifting tool or a crane.

A further advantageous embodiment of the invention envisions that the ends of the axial drive shaft, which extend fluid-tight through the bearings, are releasably coupled with the drive shaft of respectively one motor. The motors with their motor housings can be flush mounted to the adjacent mounting block. In order to accommodate the high torque occurring during the stirring of concrete, the motors preferably include a torque support or brace projecting essentially radially over the motor housing, form-fittingly anchored on the appropriate side wall.

According to a further preferred embodiment of the invention a container top piece is provided releasably seatable on the upper edge of the container lower part, selectively connectable with the container lower part and/or with the mounting block, and open upwardly and downwardly. With this means the container height can be increased and at the same time it can be accomplished that the container top piece can be removed from the container lower part with or without the agitator structural unit, for example for cleaning and servicing purposes.

Preferably the container lower part and the container top piece are connectable with each other in the edge area of the front and back wall projecting flange parts. It is useful to have the flange part projecting beyond the back wall of the container to have at least two edge open through holes, and the flange part projecting beyond the front wall to have at least two closed through holes, for the passage through of respectively one flange screw going through the flange parts of the container top piece. In order to be able to pivot the container top piece with respect to the container lower part, at least the front wall flange screws are mounted to the container top piece for articulation.

According to a further advantageous embodiment of the invention the container top piece is releasably connectable, via flange parts which project out on the side wall, in the area of its lower edge, with respectively one of the mounting blocks. For this purpose the container top piece exhibits in the area of its side wall projecting flange part at least one borehole aligned with the screw borehole of the mounting block for the securing screw.

For fluid tight sealing of the container in the area of the agitator mount, it is advantageous when the joining surfaces of the mounting block and the recess, which are adapted for conforming to each other, are provided with a circumscribing seal ring. The seal ring is preferably seated in a circumscribing notch in the mounting block.

The container top piece can be provided with a grate which covers over the through-going opening, which grate is either rigidly connected with the container top piece or is mounted pivotably with respect to the container top piece about an axis parallel to the front wall upper edge.

BRIEF DESCRIPTION OF THE DRAWING

In the following the invention will be described in greater detail on the basis of illustrative embodiments shown in schematic manner in the drawings. There is shown FIG. 1 a side view of a mobile concrete pump with rearward material supply container.

DETAILED DESCRIPTION OF THE INVENTION

Figure 1:
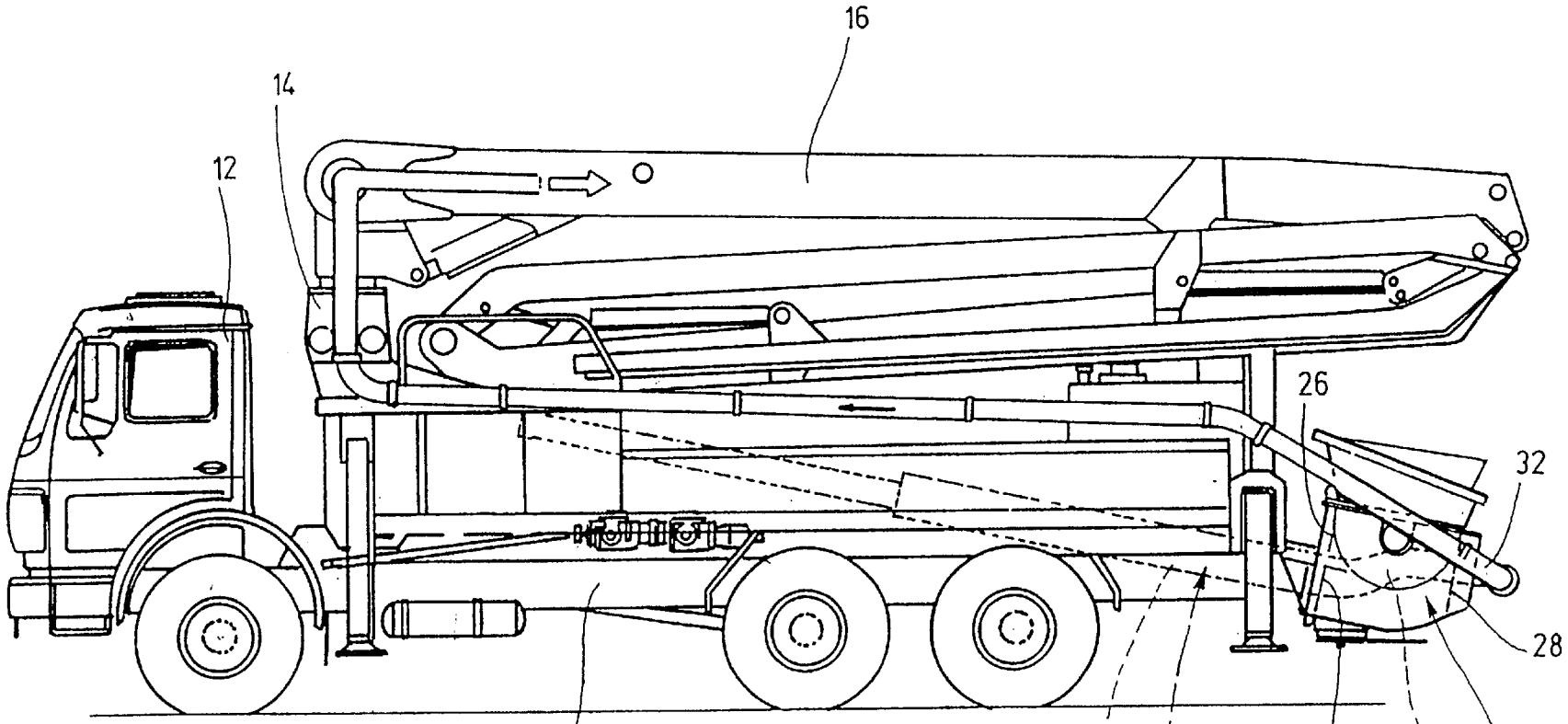
Figure 2:
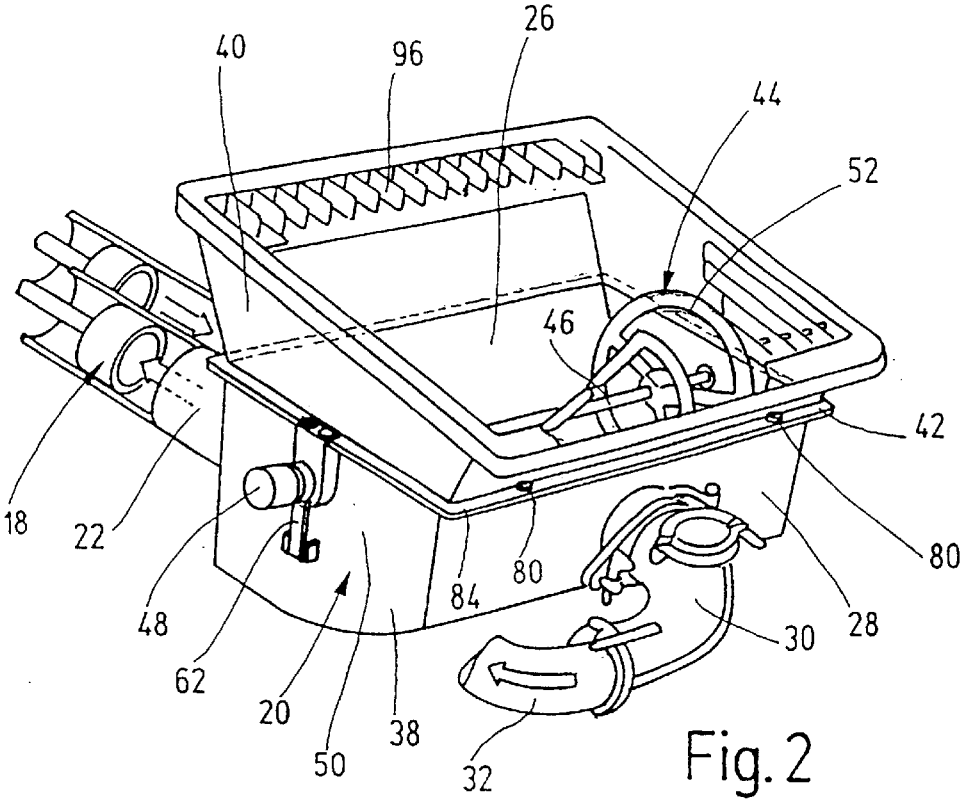
FIG. 2 a section of the two cylinder thick material pump according to FIG. 1 with agitator provided in the material supply container in perspective representation.

The mobile concrete pump shown in FIG. 1 in mobile or driving condition is comprised essentially of a vehicle chassis 10, a front driver cabin 12, a concrete distribution mast 16 mounted on a pivot bearing block 14 on the vehicle chassis and a two cylinder thick material pump 18 provided on the rearward part of the vehicle chassis. The material supply container 20 provided on the rearward part of the vehicle chassis 10 is a component of the two cylinder thick material pump 18, of which the conveyor cylinders 22 are in communication with the material supply container via conveyor cylinder openings 24 in the back wall 26. On the front wall 28 lying opposite to the back wall 26 of the material supply container 20 there is a pressure connection 30, to which the conveyor line 32 of the thick material pump is connected. In the inside of the container there is a pivot pipe 32 shown here as an S-pipe, which on its one end is connected with the pressure connection 30 and which on its other end is alternatively pivotable about an axis of a not shown pivot shaft via hydraulic means in front of the two conveyor cylinder openings 24.

The material supply container 20 is divided into a container lower part 38 and a container top piece 40, which are releasably connected with each other via a flange connection 42. In the material container there is an agitator device 44, of which the axial drive shaft 46 is driven by external hydraulic motors 48 and which extends through the inside of the container between the side walls 50 of the container lower part. The axial drive shaft 46 carries helical shaped agitator wings 52, which mix the thick fluid materials situated in the material supply container 20 and at the same time direct it to the conveyor cylinder openings 24. The axial drive shaft 46 engages with its ends 54 through respectively one pivot bearing 56, which is provided in respectively one mounting block 58. The hydraulic motors 48 are rigidly connected via their housings to the outer side of the associated mounting block 58 lying opposite to the agitator wings 52, and with their drive shafts 60 are coupled rotationally fixed with the ends 54 of the axial drive shaft 46. Besides this the hydraulic motors 48 exhibit a torque brace or support 62 projecting radially beyond the motor housing, with which they are form fittingly supportable on a receptacle or abutment 64 provided on the outer side of the side wall 50. The agitator component 44 with the mounting blocks 58 and the hydraulic motors 48 forms a structural unit, which is releasably secured to the side walls 50 of the container lower part. For this purpose the side walls 50 respectively exhibit an upwardly edge-open recess 66, which exhibit an inner contour complementary to the outer contour of the mounting blocks 58. Each of the recesses exhibit one edge part 68 extending or projecting beyond the side wall 50 on the container outer side, with an inner contour adapted to the outer contour of the associated mounting block 58. Between the joining surfaces 69 of the mounting block 58 and the recess 66, which are adapted to each other in their contour, there is provided a circumscribing sealing ring 70, which is seated in a circumscribing notch of the mounting block 58. For anchoring the mounting block 58 in the recess 66 two of the opposing parts of the outer side projecting edge parts 68 are provided with through holes 72, which are aligned with each other and with a transverse borehole 74 situated in the mounting block 58 and through which a tensioning screw 76 can be introduced for fixing the mounting block 58 in the recess 66.

Figure 3A:
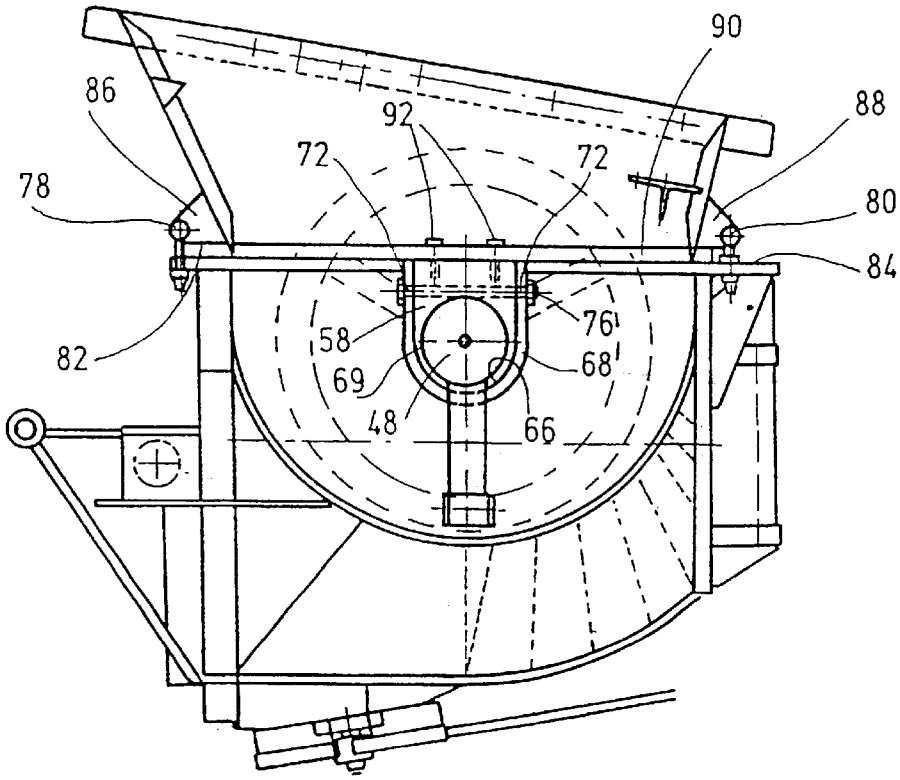
FIG. 3*a* a side view of the material supply container according to FIG. 2 with installed container top piece.

The container lower part 38 and the container top piece 40 are releasably connected with each other via flange screws 78, 80 at the rear wall and the front wall flange parts 82, 84 (FIG. 3*a*). The back wall flange parts 82 exhibit for this purpose two edge open through holes, while the front flange part 84 is provided with closed through holes. The flange screws 78, 80 are linked with their heads in cover plates 86, 88 of the container top piece 40.

The container top piece 40 is besides this releasably connectable with the mounting blocks 58 via flange parts 90 projecting towards outwards in the area of its lower side wall edge, and namely with respectively one securing screw 92, which can be screwed in through a through hole in the appropriate flange part 90 in a threaded borehole 94 situated on the mounting block 58. The sealing ring 70 running about the mounting block 58 lies in this area against the flange parts 90 from below.

The container top piece 40 is in the area of its through going opening covered over by a grate 96, which is rigidly connected with the container top piece 40 or is pivotable with respect thereto about a front axis.

Figure 3B:
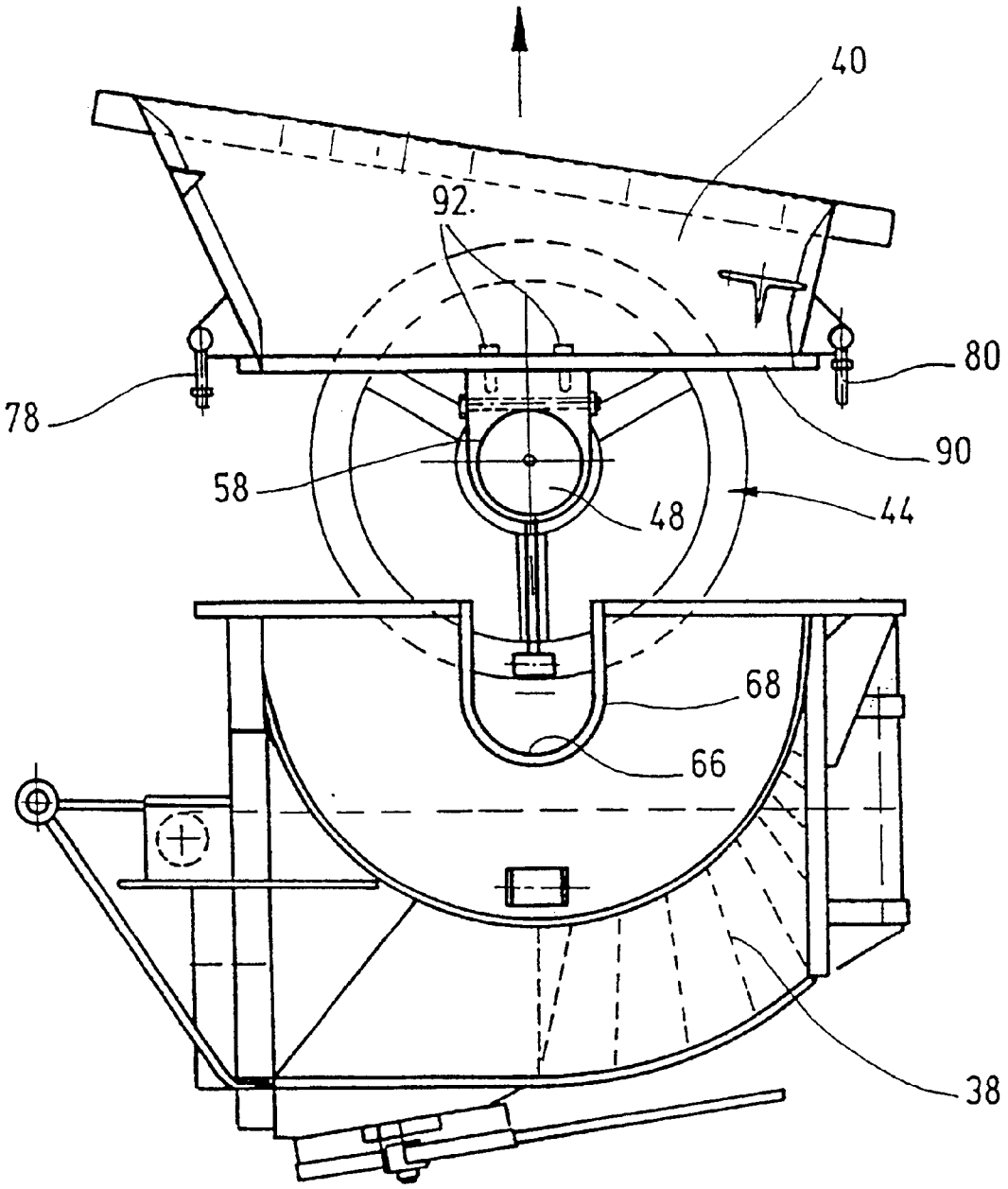
FIG. 3*b* a side view according to FIG. 3*a* with lifted structural unit comprised of container top piece and agitator.
Figure 3C:
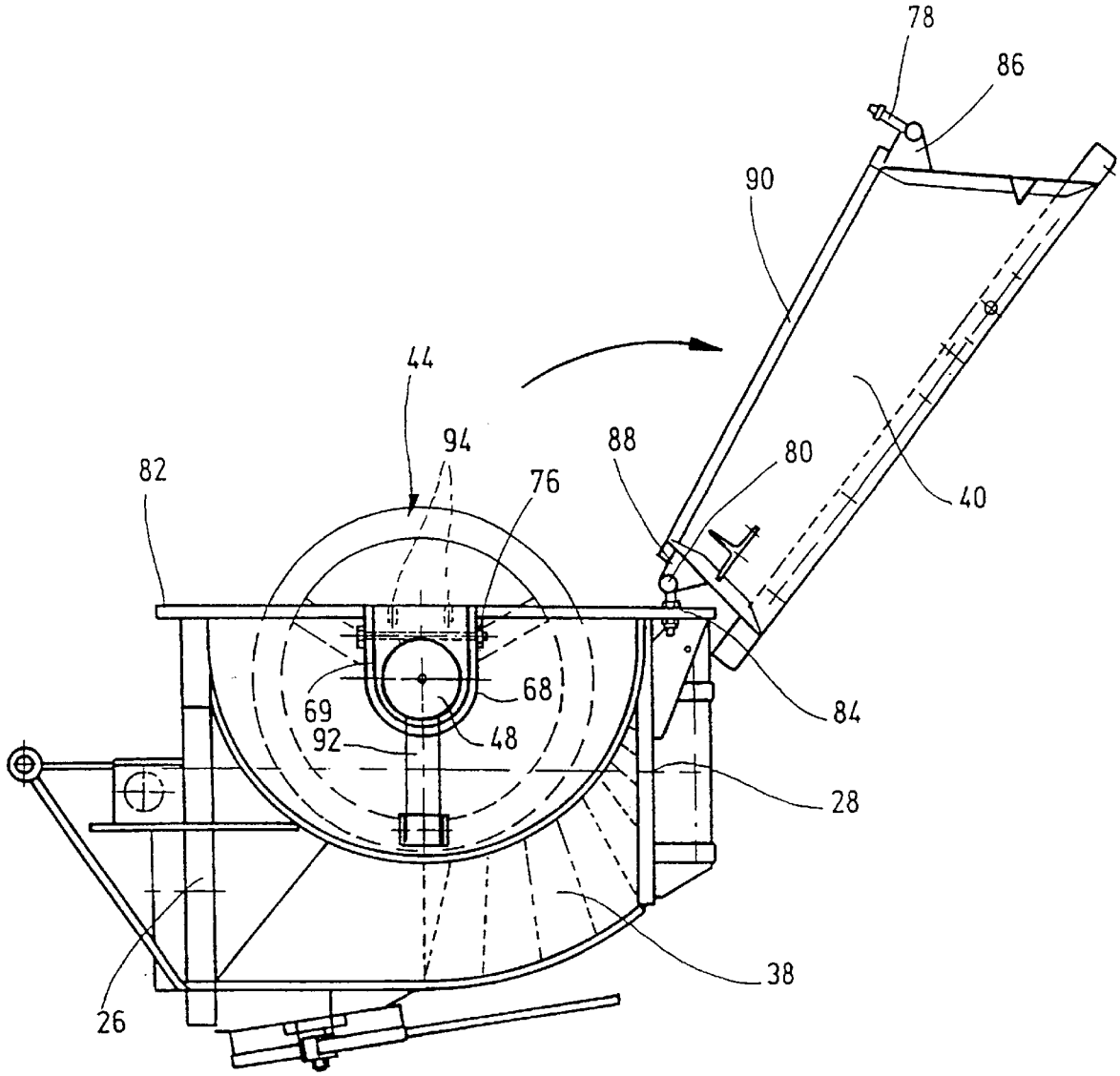
FIG. 3*c* a side view of the material supply container according to FIG. 3*a* with pivoted open container top piece.
Figure 4:
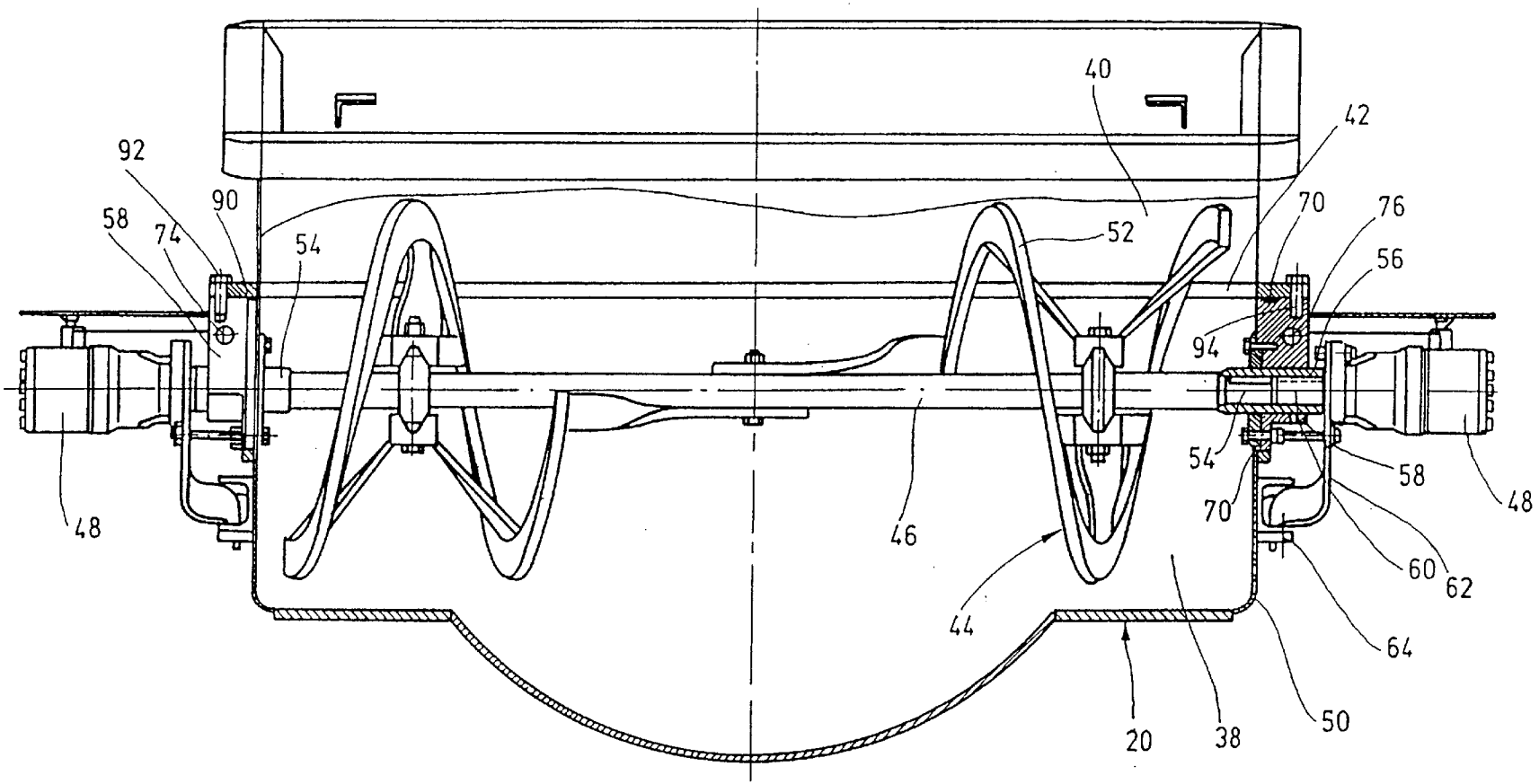
FIG. 4 a front side view of the material supply container according to FIG. 3*a* in partial sectional representation.

With the inventive means it is possible, by retracting the securing screws 92 and the flange screws 78, to pivot the container top piece 40 together with the grate 96 about the axis formed by the cover plates 88 and the flange screws 80 with respect to the container lower part 38 (FIG. 3*c*).

In this manner it is possible to hose down the material supply container for cleaning purposes after carrying out a pumping process. In this case the agitator component 44 remains in the container lower part 38.

For service purposes in the area of the pipe switch 38 it is desirable, that supplementally also the agitator component 44 is removed from the container. With the above described means the agitator component 44 together with the container top piece 40 can be lifted from the container lower part 38 (FIG. 3*b*). For this it is essentially only necessary to loosen or remove the four flange screws 78, 80 and the two tensioning screws 76 and to raise the container top piece 40 together with the agitator component 44, for example with the help of a crane, from the container lower part 38. After carrying out the servicing procedures, the container top piece 40 with the agitator component 44 can again be seated upon the container lower part 38 in the reverse sequence with few manipulative steps.

In summary the following can be concluded: The invention relates to a material feed container 20, especially for thick material pumps, comprising a lower part 38 that is upwardly open and a motor-driven agitator 44 that extends through the container lower part 38 in-between two side walls 50. In order to make the inside of the container easily accessible for cleaning and maintenance purposes, the agitator 44 is provided with a pivot bearing 56 and a drive motor 48 which together form a structural unit which is detachably connected to the lower part 38 of the container. The container is also provided with a top piece 40 that is open towards the top and bottom, can be detachably arranged on the top edge of the container lower component 38 and can be connected to the container lower component 38 and/or agitator unit if so desired. These measures make it possible to pivot or remove the top piece 40 from/in relation to the container lower component 38 without the agitator unit or to remove it from the container lower component 38 with the agitator unit.

What is claimed is:

1. A material supply container comprising an upwardly open lower container component (38) with a front wall (28), a rear wall (26) and two opposing side walls (50), and an agitator component (44) extending between the two side walls (50), the agitator component mounted via an axial drive shaft (46) in respectively one pivot bearing (56) extending through each side wall (50) and driven via at least one motor (48) provided on the outside of the container, wherein the agitator component (44) together with its pivot bearings (56) and the at least one motor (48) form a structural unit, which unit is releasably connected to the lower container component (38).

2. A material supply container according to claim 1, wherein the pivot bearings (56) are each respectively provided in one mounting block (58), wherein the side walls (50) respectively exhibit one upwardly open recess (66) having an inner contour for receiving one of the mounting blocks (58), and wherein each mounting block (58) has an outer contour conforming to the inner contour of the recess (66).

3. A material supply container according to claim 2, wherein the mounting blocks (58) are form fittingly connected with the side walls (50) via force applied parallel to the side walls (50).

4. A material supply container according to claim 2, wherein the upwardly open recess (66) of the side wall (50) includes an edge part (68) extending at least partially beyond the side wall (50) on the container outer side.

5. A material supply container according to claim 4, wherein two oppositely lying parts of the edge part (68) are provided with through holes (72), which are aligned with each other and with a transverse borehole (74) situated in the mounting block (58) dimensioned for receiving a tensioning screw (76) for fixing the mounting block (58) in the recess (66).

6. A material supply container according to claim 1, wherein the axial drive shaft has first and second ends, and wherein the axial drive shaft ends (54) are guided in fluid tight manner through the pivot bearings and are each releasably coupled with a drive shaft (60) of a respective associated motor (48).

7. A material supply container according to claim 6, wherein the motors (48) include motor housings and lie with their motor housings flush against the respective adjacent mounting blocks.

8. A material supply container according to claim 6, wherein the drive shafts of the motors rotate about an axis, the motors (48) include a torque brace (62) projecting from the motor housing essentially radially from said axis of rotation, and said torque brace (62) is anchored form fittingly in a receptacle on the associated side walls (50).

9. A material supply container according to claim 1, further including an upwardly and downwardly open container top piece (40) releasably seatable upon the upper edge of the lower container component (38), connectable with at least one of the lower container component (38) and the mounting block (58).

10. A material supply container according to claim 9, wherein the lower container component (38) and the container top piece (40) are releasably connectable with each other via flange parts (84, 82) projecting from an edge area of their front wall (28) and an edge area of their rear wall (26), respectively.

11. A material supply container according to claim 10, wherein the flange part (82) projecting beyond the rear wall (26) of the lower container component (38) is provided with at least one through-hole, the flange part (84) projecting beyond the front wall (28) is provided with at least one through-hole, and wherein one flange screw (78, 80) extends through each of said respective through-holes.

12. A material supply container according to claim 11, including at least two front wall side flange screws (80), wherein said screws are linked on the container top piece (40).

13. A material supply container according to claim 9, wherein the side walls include a lower edge, and wherein the container top piece (40) is releasably connectable with respectively one of the mounting blocks (58) via a flange part (90) projecting outwardly in the area of the lower edge of the side walls.

14. A material supply container according to claim 13, wherein the container top piece (40) in the area of its flange parts (90) projecting from the side wall exhibits at least one through hole for a securing screw (92) in alignment with a threaded borehole (94) in the mounting block (58).

15. A material supply container according to claim 2, wherein a circumscribing sealing ring (70) is provided between the conforming surfaces (69) of the mounting block (58) and the upwardly open recesses (66) of the side walls (50).

16. A material supply container according to claim 15, wherein the seal ring (70) is seated in a circumscribing notch of the mounting block (58).

17. A material supply container according to claim 9, wherein the container top piece (40) includes a grate (96).

18. A material supply container according to claim 17, wherein the grate (96) is rigidly connected with the container top piece (40).

19. A material supply container according to claim 17, wherein the grate (96) is connected to the container top piece (40) to be pivotable with respect to the container top piece (40) about an axis parallel to an axis close to the front wall and parallel to the flange part (84) of the front wall (28).

20. A mobile concrete pump with:

a vehicle chassis (10) having forward and a rearward ends;

a driver cabin (12) provided on the forward part of the vehicle chassis; and a two cylinder thick material pump (18) provided on the rearward part of the vehicle chassis, wherein said pump includes a material supply container (20) in communication with cylinder openings (24) of the pump cylinders (22), said material supply container comprising an upwardly open lower container component (38) with a front wall (28), a rear wall (26) and two opposing side walls (50), and with an agitator component (44) extending between the two side walls (50), the agitator component mounted via an axial drive shaft (46) in respectively one pivot bearing (56) extending through each side wall (50) and driven via at least one motor (48) provided on the outside of the container, wherein the agitator component (44) together with its at least one pivot bearing (56) and the at least one motor (48) form a structural unit, which unit is releasably connected to the lower container component (38).

21. A material supply container for thick material pumps, comprising an upwardly open lower container component (38) with a front wall (28), a rear wall (26) and two opposing side walls (50), and an agitator component (44) extending between the two side walls (50), the agitator component mounted via an axial drive shaft (46) in respectively one pivot bearing (56) extending through each side wall (50) and driven via at least one motor (48) provided on the outside of the container, wherein the agitator component (44) together with its pivot bearings (56) and the at least one motor (48) form a structural unit, which unit is releasably connected to the lower container component (38).

* * * * *